United States Patent [19]

Chandhoke et al.

[11] Patent Number: 4,541,763

[45] Date of Patent: Sep. 17, 1985

[54] APPARATUS FOR FORMING A STACK OF SIGNATURES

[75] Inventors: Mohanjit S. Chandhoke, Plattsburgh; Michael Duke, Rouses Point, both of N.Y.

[73] Assignee: Harris Graphics Corporation, Melbourne, Fla.

[21] Appl. No.: 518,015

[22] Filed: Jul. 28, 1983

[51] Int. Cl.[4] ..... B65H 31/30; B65H 31/32

[52] U.S. Cl. ..... 414/45; 53/156; 271/218; 414/43; 414/50; 414/98; 414/907

[58] Field of Search ..... 414/41, 42, 43, 45, 414/50, 98, 907; 271/158, 159, 192, 218; 53/156

[56] References Cited

U.S. PATENT DOCUMENTS

| | | | |
|---|---|---|---|
| 2,906,530 | 9/1959 | Matthews | 271/218 X |
| 3,107,912 | 10/1963 | Fiehl | 414/43 X |
| 3,739,924 | 6/1973 | Stobb | 414/43 |
| 4,339,119 | 7/1982 | Sasaki et al. | 271/218 X |
| 4,372,201 | 2/1983 | Dudziak et al. | 414/43 X |
| 4,451,967 | 6/1984 | Stobb | 414/907 X |

FOREIGN PATENT DOCUMENTS

| | | | |
|---|---|---|---|
| 1472248 | 5/1977 | United Kingdom | 271/218 |

*Primary Examiner*—Leslie J. Paperner

*Attorney, Agent, or Firm*—Yount and Tarolli

[57] ABSTRACT

New and useful stacking apparatus in which a stacker can form a stream of signatures into a stack, and also associate an end board with one end of the stack. Moreover, the stacker is associated with a clamping mechanism which, when it moves over to the stacker to clamp a stack of signatures, also brings an end board and deposits an end board on the stacker for association with a succeeding stack. The stacker has a main member which moves along a path between a stack receiving position and an end board receiving position. As the main member moves from the end board receiving position, the intermediate member moves out of its way. The stacker also has an interceptor for initiating formation of a stack and a unique way of transferring the partially formed stack from the interceptor to the main member. Means carried by the main member removes the stack from the interceptor and holds the stack above the main member as the interceptor approaches the main member at the stack receiving position, to allow the interceptor to be withdrawn from the stack with minimal frictional engagement. Then, the removing means are withdrawn and the stack allowed to directly engage the main member to complete the transfer of the stack from the interceptor to the main member.

9 Claims, 11 Drawing Figures

APPARATUS FOR FORMING A STACK OF SIGNATURES

BACKGROUND OF THE INVENTION

The present invention relates to an apparatus for forming a stack of signatures that are delivered from a printing press. It relates particularly to an apparatus for use in a signature handling system as shown in concurrently filed application of James Wise entitled "Signature Handling Apparatus", U.S. application Ser. No. 525,840, which is assigned to the assignee of this invention.

The aforesaid application of James Wise, discloses a system for handling signatures delivered from a printing press. The signatures are formed into stacks on a stacker, and a transfer vehicle is movable to the stacker to clamp a stack of signatures, and remove the stack from the stacker. After clamping and removing a stack from the stacker, the transfer vehicle maintains positive engagement of the stack of signatures as it moves the stack of signatures to a stack delivery station.

SUMMARY OF THE INVENTION

The present invention relates to an apparatus which provides some particularly useful improvements in a system according to the aforesaid disclosure of James Wise.

According to one aspect of the invention, a stacker is designed not only to form a stream of signatures into a stack, but also to associate an end board with one end of the stack. Moreover, the clamping mechanism, when it moves over to the stacker to clamp a stack of signatures, also brings two end boards and deposits one end board on the stacker for association with a succeeding stack. Thus, each time the clamping mechanism removes a stack of signatures from the stacker, it deposits an end board with the stacker, and the stacker, in turn, associates that end board with the next succeeding stack which it forms.

According to another aspect of the present invention, the stacker has a main member which moves along a path between a stack receiving position and an end board receiving position. As it moves from the stack receiving position toward the end board receiving position, the main member deposits a stack of signatures on an intermediate member which holds the stack in position to be engaged by a clamp on the transfer vehicle. As the main member moves from the end board receiving position, the intermediate member moves out of its way, so that the main member, with an end board thereon, can move back along the path to receive a new stack without being impeded by the intermediate member.

Yet another aspect of the present invention relates to the manner in which the main member receives a stack at the stack receiving position. Specifically, an interceptor with a partial stack thereon, moves toward the main member as the main member moves toward the stack receiving position. At the stack receiving position, the main member stops, and the interceptor continues to move toward the main member. As the interceptor moves toward the stopped main member, means carried by the main member engages the stack and strips the stack from the interceptor. Ths stripping means holds the stack above the main member, and the interceptor is then withdrawn from the stack with minimal frictional engagement. Then, the stripping means is disengaged from the stack, and the stack directly engages the main member to complete the transfer of the stack from the interceptor to the main member.

BRIEF DESCRIPTION OF THE DRAWINGS

The further features and advantages of this invention will become further apparent from the following detailed description taken with reference to the accompanying drawings wherein.

DESCRIPTION OF PREFERRED EMBODIMENT

Figure 1:
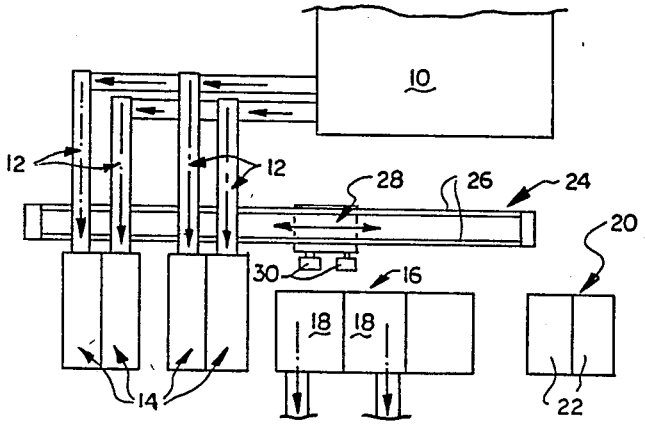
FIG. 1 is a schematic illustration of a signature handling system with stackers incorporating the principles of this invention.

As discussed above, a stacker according to the invention is particularly useful in a signature handling system according to the concurrently filed application of James Wise (U.S. Ser. No. 525,840), which is incorporated herein by reference. A system according to the principles of the aforesaid application of Mr. Wise is shown schematically in FIG. 1. It includes a printing press 10, a plurality of delivery conveyors 12, each of which delivers a stream of signatures in overlapped, shingled fashion from the press 10. A plurality of adjacent stackers 14, constructed according to the principles of the present invention, are disposed to receive signatures from respective ones of the delivery conveyors 12. A tying station 16, comprising a pair of tyer mechanisms 18, is disposed adjacent the stackers 14. At the tying station 16, stacks of signatures can be tied into logs or bundles. An end board station 20 is disposed adjacent the tying station 16. The end board station 20 contains a supply of end boards, which can be received by a transfer vehicle 28.

The transfer vehicle 28 moves along a guide track 24, which is defined by a pair of spaced, parallel rails 26 that run past the foregoing stations. The transfer vehicle 28 has a pair of clamping mechanisms 30 for clamping stacks of signatures from a pair of stackers 14. According to the principles of the present invention, each clamping mechanism 30 can also bring an end board over to a stacker, and deposit the end board on the stacker. The stacker can then take the end board and associate that end board with a succeeding stack of signatures formed on the stacker.

The transfer vehicle 28 is also constructed according to the further principles of a concurrently filed application of Frank Convey entitled "Signature Transfer Vehicle With Stack Clamping Mechanism", Ser. No. 518,014, now U.S. Pat. No. 4,498,381, which is assigned to the assignee of this invention, and which is incorporated herein by reference. Specifically, according to that further disclosure, the clamping mechanism contains a means which strips an end board therefrom and deposits the end board on the stacker as the clamping mechanism clamps a stack of signatures. Moreover, according to an additional aspect of that disclosure, after removing a stack from the stacker 14, the clamping mechanism 30 is designed to completely contain the stack on all sides, and maintains that containment of the stack as it moves the stack and transfer the stacks of signatures to the tying station 16 where the stack of signatures is tied into a log. According to a still further aspect of that disclosure, each clamping mechanism can apply varying pressures to the top of a stack of signatures clamped thereon.

Figure 10:
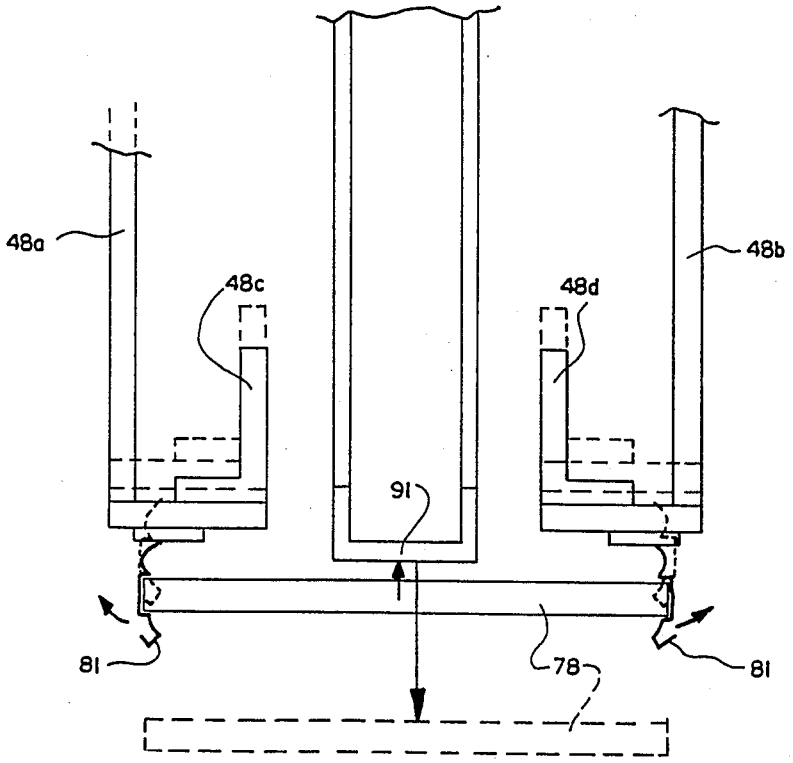
FIG. 10 schematically illustrates the manner in which an end board is held on a clamping mechanism, and is stripped therefrom during the clamping operation for deposit onto the stacker.

Each clamping mechanism 30 on the transfer vehicle includes a movable top clamp assembly 46 and a movable bottom clamp assembly 48. The clamp assemblies 46, 48 can move linearly toward each other to clamp a stack of signatures therebetween, and can move linearly away from each other to release a stack of signatures. Each clamp assembly 46, 48 has a pair of downwardly depending spring fingers 81 (FIG. 10 shows the pair of spring fingers 81 on the lower clamp assembly 48), for engaging an end board (shown at 78 in FIG. 10).

Figure 11:
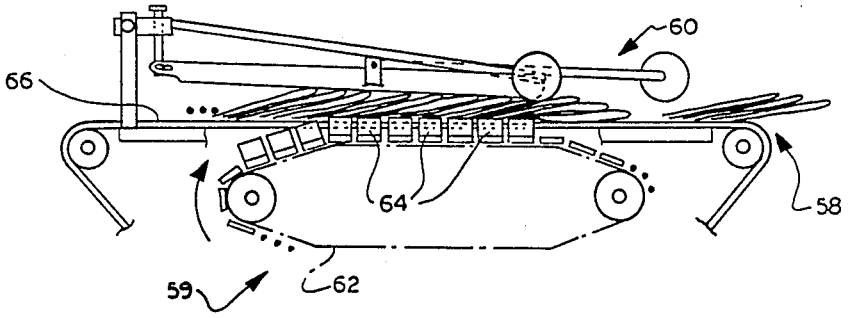
FIG. 11 schematically illustrates a mechanism for forming a gap in a stream of signatures approaching the stacker.

Signatures are delivered by each delivery conveyor 12 to a respective stacker 14 in a shingled, overlapped fashion. As signatures move along a main conveyor portion 58 toward the stacker, they pass a gapper 59, a mechanism for creating a gap in the stream of signatures. The gapper 59 is shown in FIG. 11. It is constructed in accordance with application Ser. No. 419,775, of Michael Duke, filed Sept. 20, 1982 entitled "Stream Gapper Mechanism", which is assigned to the assignee of this application, and incorporated herein by reference. It includes a retarding roller assembly 60 disposed above the main conveyor 58, and a separator conveyor 62 associated with the main conveyor 58. The separator converyor 62 includes a series of slats 64 which, when the separator conveyor 62 is energized, travel along a path which brings them above the conveying surface 66 of the main conveyor 58. Thus, the slats 64 raise up the signatures being conveyed along the main conveyor 58. The signatures that are raised up then engage the retarding roller assembly 60 which retards the movement of signatures in the stream, while the main conveyor 58 continues to convey the remaining signatures downstream from the retarding roller assembly 60. After a gap is formed, the slats 64 on the separator conveyor 62 move out of contact with the signatures, lowering the signatures onto the conveying surface of the main conveyor 58, and resume their movement in a shingled, overlapped stream. However, a gap is now created in the stream of moving signatures.

Figure 2:
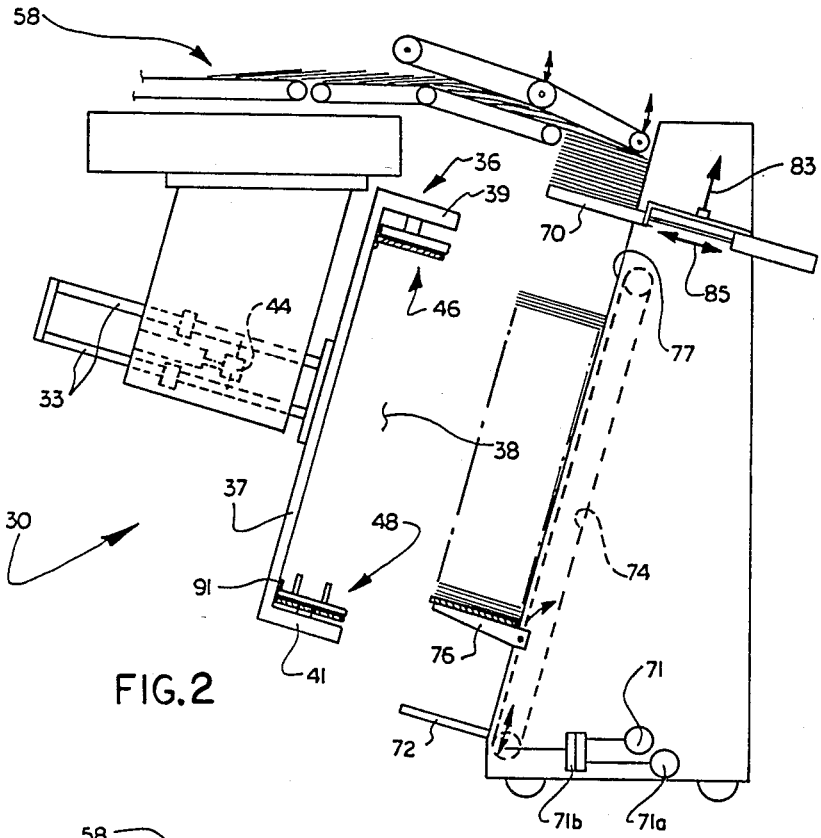
FIG. 2 is a schematic illustration of a stacker formed according to the invention, with a transfer vehicle disposed in a stack pickup position with its clamping mechanism ready to engage the stack of signatures.

A stacker 14 according to the present invention is shown in FIG. 2. It includes an interceptor 70, a main fork 72, and an intermediate support member 76, all of which are shown in FIG. 2 at various locations along a path defined by a slightly inclined, generally upright frame surface 77. The interceptor 70 can move along the path defined by the frame surface 77, as shown by arrows 83. It can also move transverse to the path defined by the frame surface 77, as shown by the arrows 85. As the signatures arrive from the main conveyor 58, they begin to form a stack on the interceptor 70. The interceptor 70 can move downward along the path defined by frame surface 77 at a rate synchronized with the arrival of signatures so that the top of the stack always remains at about the same level.

The main fork 72 is mounted for reciprocating movement along the path defined by the inclined frame surface 77, and forms a continuation of the path of the interceptor 70. The main fork 72 is connected with an endless chain 74 which is driven by reversible motors 71, **71*a* through a brake and clutch mechanism 71*b*. One motor (e.g., motor 71) drives the chain 74 at a high speed, and the other motor (e.g., motor 71*a*) drives the chain 74 at a low speed. Alternatively, the chain 74** can be driven by a single variable speed motor.

When a partially formed stack of signatures on the interceptor 70 has reached a predetermined size, it is transferred from the interceptor 70 to the main fork 72 at a stack receiving position. During the transfer, the interceptor 70 is withdrawn from the path defined by the inclined frame surface 77 and the stack can continue to grow by moving the main fork 72 gradually downward along the path defined by the inclined frame surface 77 while signatures are being delivered to the stacker. The interceptor 70 is then returned to a position where it can, when directed, move back to its intercept position to intercept signatures from being delivered to the stacker by the main conveyor 58, to begin building another stack.

Figure 4:
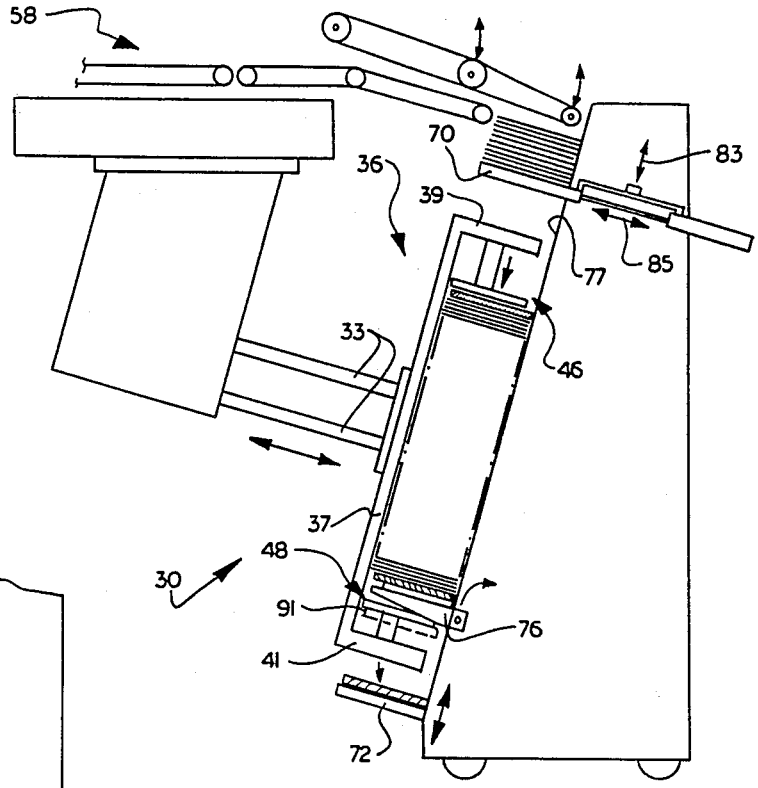
FIG. 4 is a further schematic illustration showing the stacker of the invention as a clamping mechanism clamps a signature and deposits an end board on the stacker.

As the main fork 72 moves downwardly with the stack, it transfers the stack of signatures to the intermediate support member 76, which is disposed at a predetermined location along the path defined by the inclined frame surface 77. The intermediate support member 76 supports the stack of signatures in a position to be engaged by a clamping mechanism 30 on the transfer vehicle 28. After transferring a stack to the intermediate support 76, the main fork 72 continues to move downwardly along the path defined by the inclined frame surface 77 to an end board receiving position in which it can receive a lower end board for the next stack of signatures formed on the stacker. FIG. 4 shows the main fork 72 in an end board receiving position.

Figure 5:
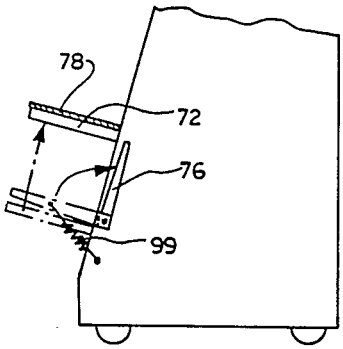
FIG. 5 schematically illustrates the manner in which an intermediate holding member is moved out of the way of a main fork on the stacker, as the main fork moves from an end board receiving position to a stack receiving position.

After receiving a lower end board, the main fork 72 moves back along the path defined by the inclined frame surface 77 to receiving a new stack from the interceptor 70. According to the present invention, the intermediate member 76 moves out of the way of the main fork 72 as the main fork moves back along the path defined by the inclined frame surface. Specifically, the intermediate member 76 is pivotally supported on the frame, and can pivot upwardly relative thereto. As schematically shown in FIG. 5, as the main fork 72 moves upward, it pivots the intermediate member 76 upwardly and out of its way, thus allowing the main fork 72 to move upwardly past the intermediate member 76. Then, the intermediate member 72 returns to the position shown in FIG. 2, where it can receive a succeeding stack of signatures from the main fork 72 as the main fork 72 moves that succeeding stack downwardly.

The intermediate member 76 may return to the position shown in FIG. 2 under the influence of gravity or by other means such as an air cylinder, spring, etc. Preferably, a spring 99 biases the intermediate member 76 to the position shown in FIG. 2.

The operation of the interceptor 70 is in part controlled by the detection of gaps in the stream of signatures on the main conveyor 58. Specifically, a sensor (e.g., a photocell) senses the presence of a gap in the stream of signatures. The sensor controls the movement of the interceptor 70 so that when a gap is sensed, the interceptor 70 is moved into position to intercept the signatures that are intended to form a successive stack.

The mechanism that initiates creation of a gap in the signature stream is controlled by the sensing of a dimensional characteristic of the stack on the main fork 72. More specifically, a sensor such as a limit switch, photocell, etc., can sense when a stack of a predetermined dimension has been created on the main fork 72. Alternatively, the sensor can be in the form of a counter that determines when a predetermined number of signatures have been delivered to the stacker. The sensor energizes the separator conveyor 62 until a gap is created in the stream of overlapped signatures.

The manner in which a stack is transferred from the interceptor 70 to the main fork 72, and the manner in which a lower end board 78 is associated with the bottom end of the stack, is shown in FIGS. 6–9. The main fork 72 has an upper support surface 73 and a pair of support arms 80 with rollers 87 at their ends. The support arms 80 are controlled by a linkage 93 that includes a linearly reciprocable actuator member 95 that is driven in either linear direction by an air cylinder 97. When the actuator member 95 is moved in one direction, the support arms 80 are moved to a first position (FIG. 6) in which the rollers 87 are disposed above the support surface 73. In that first position, if a lower end board 78 is on the support surface 73 of the main fork 72, the rollers 87 are also disposed above the end board 78. The actuator 95 can be moved in an opposite linear direction to move the support arms 80 to a second position (FIG. 9) in which they are clear of the support surface 73 on the main fork 72.

Figure 6:
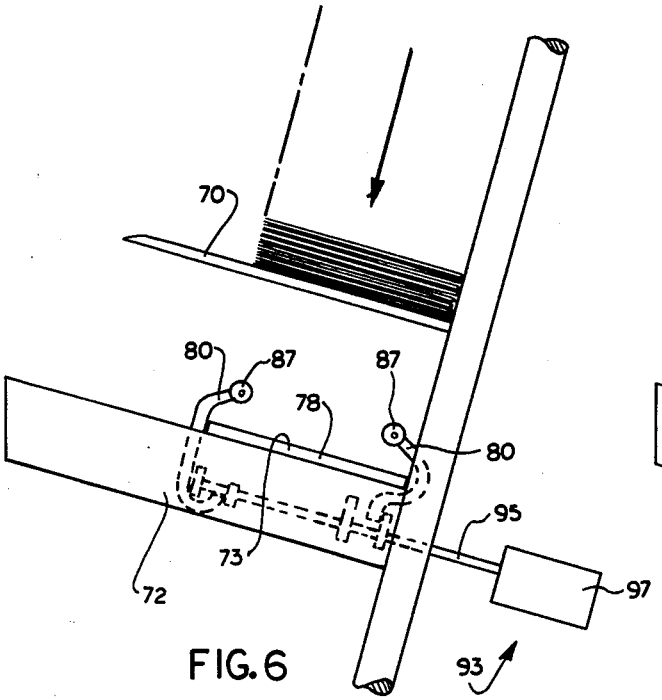
FIGS. 6–9 illustrate schematically the manner in which a stack of signatures is transferred between a pair of members on the stacker and associated with end board according to the principles of this invention.
Figure 7:
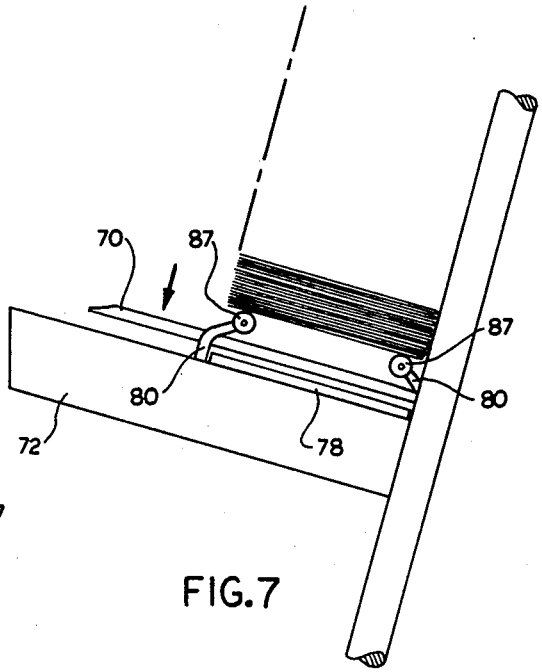
Figure 8:
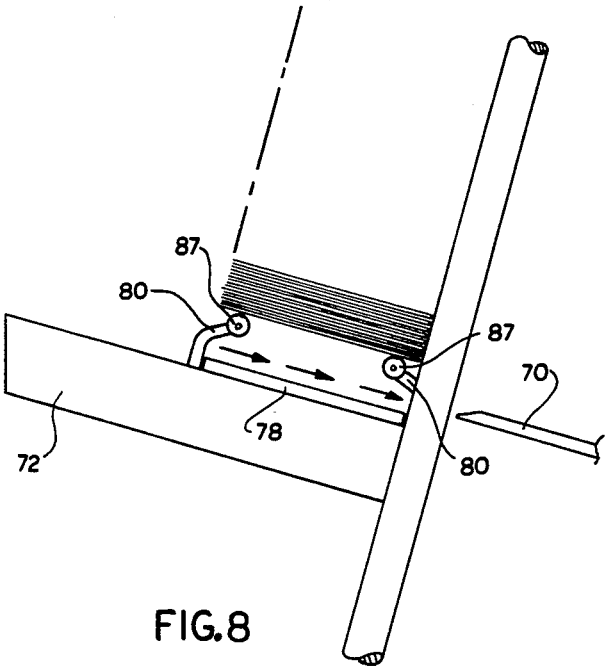
Figure 9:
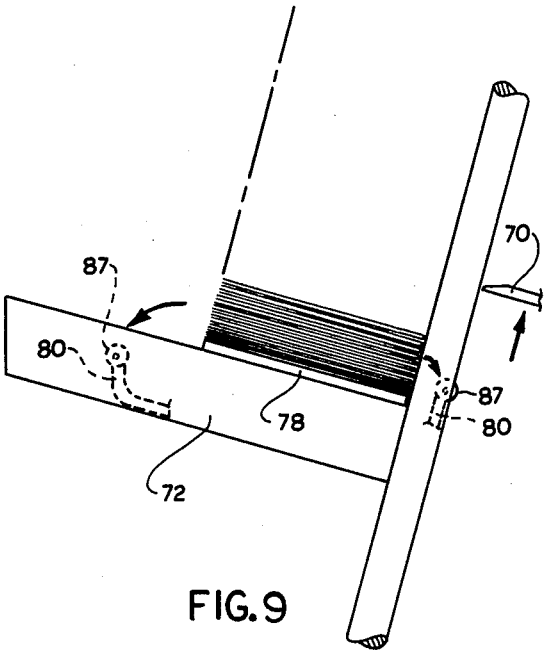

When the main fork 72 is stopped at a stack receiving position, and the interceptor 70 is moving downwardly toward the main fork the actuator 95 has the arms 80 in their first position. The bottom end of a stack of signatures on the interceptor 70 will thus be engaged by the rollers 87, stripped from the interceptor 70, and held slightly above the lower end board 78 as the interceptor 70 continues to move downwardly (FIG. 6). Then, while the bottom end of the stack of signatures is being held above the end board 78, the interceptor 70 is withdrawn in a direction transverse to the path defined by the inclined frame surface 77 (FIG. 8). The actuator 95 then moves the arms 80 to their second position, which moves them out of engagement with the stack (FIG. 9). Thus, the bottom end board 78 can directly engage the stack of signatures.

In handling a stack of signatures, the transfer vehicle 28 first moves to the end board pickup station 20. There, the clamping mechanism 30 receives a pair of end boards that are engaged by the spring finger clamps 81 or other suitable means on the top and bottom clamp assemblies 46, 48. Thus, a top end board 79 and a bottom end board 78 are both connected with the clamping mechanism 30.

Figure 3:
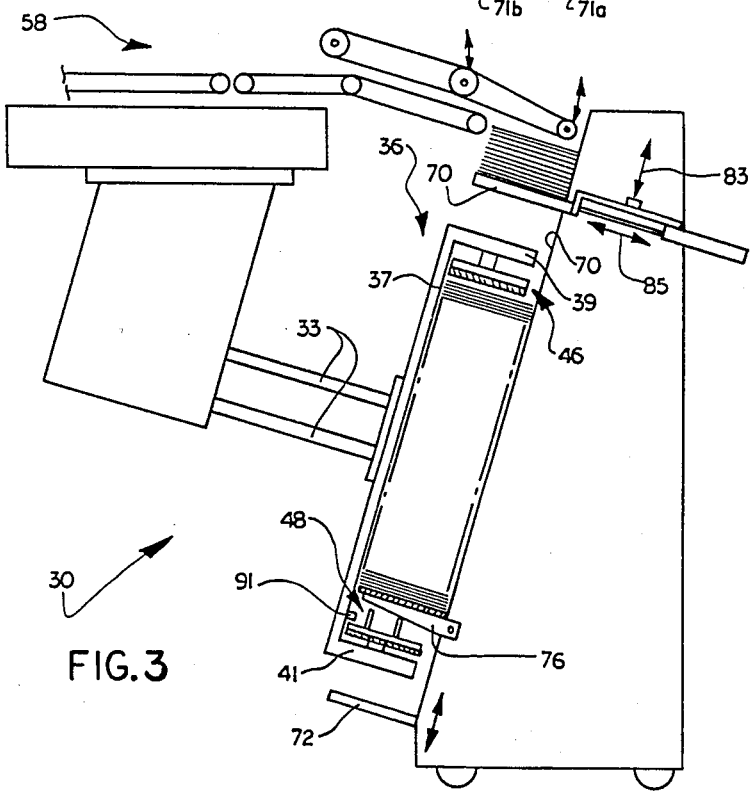
FIG. 3 is a schematic illustration of the stacker of the invention, with the clamping mechanism on the transfer vehicle extended to a position in which it can clamp the stack of signatures.

The transfer vehicle 28 then moves along the guide track 24 to a stack pickup position in which the clamping mechanism 30 is aligned with a respective stacker 14 (FIG. 2). The clamping mechanism 30 is moved to an extended position, and as that happens, a stack of signatures on the intermediate member 76 of the stacker 14 passes through the front side 38 of the clamping mechanism, and is disposed between the upper and lower clamp assemblies 46, 48 (FIG. 3). The top and bottom clamp assemblies 46, 48 are then moved toward each other in order to clamp a stack of signatures on the stacker 14 (FIG. 4). More specifically, the bottom clamp assembly 48 has upwardly extending fingers **48*c*, 48*d* that can interdigitate with the intermediate support 76 that supports the stack and a bottom end board 78 on the stacker. As the lower clamp assembly 48 moves upward the fingers 48*c*, 48*d* pass through the intermediate support member 76 supporting the stack, and lift the stack off the intermediate member 76. Then, the upper clamp assembly 46 presses downward on the stack, thus pressing a top end board 79 against the top of the stack and clamping the stack between the clamp assemblies 46, 48**.

According to the present invention, the lower end board 78 is deposited onto the main fork 72 while the main fork 72 is at the end board receiving position, and the clamping mechanism 30 is disposed above the end board receiving position (FIGS. 3, 4). The present invention contemplates that the the lower end board is removed from the clamping mechanism 30 and deposited on the main fork 72, when the clamping mechanism 30 and the main fork 72 are in the relative orientations shown in FIGS. 3, 4. The preferred embodiment is constructed according to the aforesaid further improvement of Frank Convey (Ser. No. 518,014). Specifically, a stripper, shown schematically at 91 in FIGS. 2–4 and 10, is carried by the clamping mechanism 30, and is normally disposed above the lower clamp assembly 48. During the clamping of a stack, as the lower clamp assembly 48 moves upward, the lower end board 78 engages that finger 91, and is stripped therefrom. It falls onto the main fork 72, which is at the end board receiving position.

After completing the clamping of a stack, the clamping mechanism is retracted to remove the stack from the stacker 14 while maintaining clamping engagement with the stack. After the clamping mechanism 30 is clear of the stacker 14, a pair of front retainers on the clamping mechanism are pivoted into positions in which they complete the retainment of the stack. After removing a stack from the stacker 14, the transfer vehicle 28 moves the stack to the tyer station 16, or to any other delivery station in the system.

Having described a specific preferred embodiment of the invention, the following is claimed:

1. Signature stack handling apparatus comprising a stack supporting main member movable along a path between a stack receiving position to an end board receiving position, an intermediate support member disposed along said path for receiving a stack of signatures from said main member as said main member moves from said stack receiving position to said end board receiving position, said intermediate support member being movable out of said path as said main member moves from said end board receiving position to said stack receiving position, said main member being adapted to transport an end board from the end board receiving position to the stack receiving position, and means for associating the end board with one end of a stack at the stack receiving position, said intermediate support member being pivotally supported at a predetermined location along said path, said intermediate support member being adapted to be engaged by said main member and pivoted out of the way of said main member as said main member moves from said end board receiving position to said stack receiving position.

2. Apparatus as set forth in claim 1 including an interceptor for moving a stack of signatures toward said main member when said main member is at said stack receiving position.

3. Apparatus as set forth in claim 2 wherein said main member includes means for removing a stack of signatures from said interceptor as said interceptor approaches said main member at said stack receiving position, said interceptor being movable out of said path when a stack is removed therefrom, and said removing means being disengageable from a stack after the interceptor is moved out of said path.

4. Signature stack handling apparatus comprising an interceptor which initiates formation of a stack and moves along a path, a main support member movable along said path to a stack receiving position to receive a stack of signatures from said interceptor, said interceptor being movable along said path toward said main member when said main member is at said stack receiving positiion, means on said main member for removing a stack of signatures from said interceptor and for holding the stack of signatures as said interceptor moves along said path toward said main member at said stack removing position and out of said path when a stack is removed therefrom, said removing means being disengageable from the stack after the interceptor is moved out of the path to allow the stack to directly engage the main member.

5. Apparatus as set forth in claim 4 wherein said main member has a stack support surface, said removing means being movable to a first position in which it is disposed above said stack support surface for removing a stack of signatures from said interceptor, said removing means being movable to a second position in which it is clear of said stack support surface to disengage said removing means from a stack.

6. Apparatus as set forth in claim 5 wherein said removing means includes pivotable arm means having stack receiving means thereon and means for pivoting said arm means between said first and second positions, said means for pivoting said arm means comprising actuator means connected with said arm means and means for effecting actuation of said actuator means.

7. Apparatus as set forth in claim 6 wherein said actuator means is a linearly reciprocable actuator member and said means for effecting actuation of said actuator means is a fluid motor.

8. Apparatus comprising a stacking means for forming a stream of signatures into a stack, a clamping mechanism being movable to the stacking means to clamp a stack of signatures and withdraw the stack of signatures from the stacking means, said stacking means adapted to form a succeeding stack to replace the stack that has been removed therefrom, said clamping means being adapted to deliver an end board to the stacking means, and the stacking means being adapted to associate the end board with the succeeding stack formed by said stacking means.

9. Apparatus as set forth in claim 8, wherein said clamping mechanism includes means for retaining a pair of end boards as it moves to the stacking means, said clamping mechanism including means for clamping one of the end boards against one end of the stack during the clamping of the stack and for depositing the other end board on the stacker for disposition by the stacker against one end of a succeeding stack of signatures on the stacker.

* * * * *